US008139018B2

(12) United States Patent
Kim

(10) Patent No.: US 8,139,018 B2
(45) Date of Patent: Mar. 20, 2012

(54) LIQUID CRYSTAL DISPLAY DEVICE AND METHOD FOR DRIVING THE SAME

(75) Inventor: Hyuk Jin Kim, Daejeon-si (KR)

(73) Assignee: LG Display Co., Ltd., Seoul (KR)

( * ) Notice: Subject to any disclaimer, the term of this patent is extended or adjusted under 35 U.S.C. 154(b) by 988 days.

(21) Appl. No.: 11/640,850

(22) Filed: Dec. 19, 2006

(65) Prior Publication Data

US 2008/0001911 A1 Jan. 3, 2008

(30) Foreign Application Priority Data

Jun. 30, 2006 (KR) ..... 10-2006-0060314

(51) Int. Cl.
*G09G 3/36* (2006.01)

(52) U.S. Cl. ..... 345/101; 345/102

(58) Field of Classification Search ..... 345/102, 345/87, 101
See application file for complete search history.

(56) References Cited

U.S. PATENT DOCUMENTS

2002/0067332 A1* 6/2002 Hirakata et al. ..... 345/102
2004/0252097 A1* 12/2004 Kaneki et al. ..... 345/102
2005/0259064 A1* 11/2005 Sugino et al. ..... 345/102

* cited by examiner

*Primary Examiner* — Amr Awad
*Assistant Examiner* — Andre Matthews
(74) *Attorney, Agent, or Firm* — Birch, Stewart, Kolasch & Birch, LLP

(57) ABSTRACT

A method for driving a liquid crystal display device is provided. The liquid crystal display device includes a liquid crystal panel and a plurality of lamps. The method includes: sequentially driving the plurality of lamps to supply light to the liquid crystal panel, at least one of the lamps having a different on-time interval from another one of the lamps.

24 Claims, 8 Drawing Sheets

LIQUID CRYSTAL DISPLAY DEVICE AND METHOD FOR DRIVING THE SAME

This Nonprovisional Application claims priority under 35 U.S.C. §119(a) on Patent Application No. 10-2006-0060314 filed in Korea on Jun. 30, 2006, the entire contents of which are hereby incorporated by reference.

BACKGROUND OF THE INVENTION

1. Field of the Invention

The present invention relates to a liquid crystal display device, and more particularly, to a liquid crystal display device for improving moving picture quality and a method for driving the same.

2. Description of the Related Art

Since a liquid crystal display (hereinafter referred to as an LCD) is lightweight and slim and has low power consumption, its fields of application are broad. Accordingly, the LCD is used in an office automation device, an audio/video device, etc. On the other hand, the LCD displays a desirable image on a screen by adjusting an amount of light beam transmission according to image signals that are applied to a plurality of switches disposed in a matrix. Since the viewers pursue better moving picture quality, a liquid crystal material or a driving method has been under development attempting to meet the viewers' requirements.

A cathode-ray tube (CRT) utilizes an impulsive type light source that emits light by an injection of an electron gun. The LCD utilizes a hold type light source that emits light by a backlight system that employs a linear lamp (a fluorescent lamp) as a light source. Therefore, it is difficult for the LCD to display perfect moving pictures. That is, when moving pictures are displayed on the LCD, its hold property causes deterioration in an outline of an image. Thus, the image quality deteriorates (e.g., motion blurring occurrence). To prevent the moving picture outline deterioration, there is provided an LCD according to a backlight scanning method that employs a direct-type backlight including a plurality of lamps disposed across the LCD.

FIG. 1 is a block diagram of a driving device in a related art LCD device. FIG. 2 is a sectional view of a backlight unit and an LCD panel of FIG. 1.

Referring to FIGS. 1 and 2, the driving device in an LCD device according to a related art backlight scanning method includes an LCD panel 2, a data driving unit 4, a gate driving unit 6, a backlight unit 10, a lamp driving unit 12, and a timing controller 8. The LCD panel 2 includes data lines and gate lines, which are intersected and the TFTs are formed adjacent to the intersection points. The data driving unit 4 supplies data to the data lines of the LCD panel 2. The gate driving unit 6 supplies gate pulses to the gate lines of the LCD panel 2. The backlight unit 10 projects light on the LCD panel 2 by sequentially driving a plurality of lamps 30. The lamp driving unit 12 controls the backlight unit 10. Additionally, the timing controller 8 controls the data driving unit 4 and the gate driving unit 6 and simultaneously drives the lamp driving unit 12.

As illustrated in FIG. 2, the backlight unit 10 includes a plurality of lamps 30, a lamp housing 22 surrounding the plurality of lamps 30, and a diffusion plate 20 covering the lamp housing 22.

The plurality of lamps 30 are sequentially driven in response to a control of the lamp driving unit 12. The lamp housing 22 surrounds the plurality of lamps 30, and also reflects the light emitted from the plurality of lamps toward the diffusion plate 20 by using a reflective surface 24. The LCD panel 2 includes two glass substrates and liquid crystal interposed therebetween. The TFT is formed adjacent to an intersection of the data line and the gate line in the LCD panel 2, and supplies the data into a liquid crystal cell through the data line in response to a scanning pulse outputted from the gate driving unit 6. A source electrode of the TFT is connected to the data line, and a drain electrode of the TFT is connected to a pixel electrode of the liquid crystal cell. Additionally, a gate electrode of the TFT is connected to the gate line. The LCD panel 2 is stacked on the diffusion plate 20 of the backlight unit 10.

The timing controller 8 rearranges the digital video data supplied from a digital video card (not shown) by red R, green G, and blue B. The data RGB rearranged by the timing controller 8 is supplied to the data driving unit 4. Additionally, the timing controller 8 generates a data control signal and a gate control signal by using horizontal/vertical synchronization signals H and V inputted into the timing controller 8. The data control signal includes a dot clock Dclk, a source shift clock SSC, a source enable signal SOE, a polarity signal POL, etc., and also supplies them to the data driving unit 4. The gate control signal includes a gate start pulse GSP, a gate shift clock GSC, a gate output enable GOE, etc., and also supplies them to the gate driving unit 6. Additionally, the timing controller 8 controls the lamp driving unit 12 to sequentially drive the backlight unit 10 when data is completely supplied to a liquid crystal cell.

After sampling the data in response to a data control signal from the timing controller 8, the data driving unit 4 latches the sampled data by one line, and then converts the latched data into an analog gamma voltage from a gamma voltage supplying unit (not shown).

The gate driving unit 6 includes a shift register and a level shift. The shift register sequentially generates gate pulses in response to a gate start pulse GSP in gate control signals outputted from the timing controller 8. The level shift shifts a voltage level of the gate pulse into a voltage level appropriate for driving a liquid crystal cell.

The lamp driving unit 12 sequentially drives the plurality of lamps 30 of the backlight unit 10 in response to a lamp driving control signal from the timing controller 8. That is, the lamp driving unit 12 completely supplies a data voltage into the liquid crystal cell, and then sequentially drives the plurality of lamps 30.

FIG. 3 illustrates a method for driving scanning in a related art backlight unit. FIGS. 4A and 4B illustrate a ghost phenomenon in the first and eighth lamps of FIG. 3.

Referring to FIGS. 3, 4A and 4B, when a vertical synchronization signal Vsync dividing each image frame is applied to an LCD panel, the gate output signals are sequentially applied to the gate lines corresponding to one frame in the LCD panel.

At this point, the plurality of lamps in the backlight unit are sequentially driven in synchronization with a drive signal applied to the gate line. That is, the first lamp changes from an on-state into an off-state when a gate output signal is applied to one of the N number of gate lines to supply a data voltage into a pixel region of the LCD panel. Additionally, the second lamp changes from an on-state into an off-state when a gate output signal is applied to another gate line, which is next to the gate line corresponding to the first lamp, to supply the data voltage into a pixel region of the LCD panel completely.

Accordingly, as illustrated in FIG. 3, when the gate output signal is applied to the gate line, the first to eighth lamps are sequentially turned on/off with the same interval t1.

However, the direct-type LCD device including a plurality of lamps has respectively different temperatures in different regions due to a convection phenomenon in the backlight unit.

A temperature difference between the first gate line region and the Nth gate line region is 10° C. or higher. The temperature difference causes the difference of the liquid crystal response time . Therefore, a pixel response time of the Nth gate line region is slower than that of the first gate line region.

The pixel response time difference due to the temperature difference causes a ghost phenomenon because an interval of a lamp in an on-state is broad even if a pixel region is opened.

The first lamp region corresponding to the first gate line region has a higher temperature than the eighth lamp region corresponding to the last gate line region. Thus, the pixel response time of the first lamp region is faster than that of the eighth lamp. As illustrated in FIG. 4A, when the first lamp is turned on or off, the on/off property (response time) of the pixel region in the LCD panel is in a pixel-on-state until the first lamp is turned on for the next image frame. When a pixel is in an off-state, the first lamp of the next image frame is turned on. At this point, when the pixel region is in an off-state, there is an overlapping interval where the lamp is in an on-state. Therefore, the ghost phenomenon occurs.

However, as illustrated in FIG. 4B, in a region having relatively lower temperature than the first lamp region, a pixel region is in an on-state until the eighth lamp is turned on. Therefore, since the liquid crystal response time becomes slower due to the low temperature, it takes more time to change from an on-state into an off-state. Consequently, a ghost region becomes broader than before.

When the ghost region becomes broader, an afterimage occurs when displaying a moving picture, thereby deteriorating the image quality. In particular, since the eighth lamp region in a low temperature is a region displaying the subtitle in an LCD TV, it is difficult to identify the subtitle due to the afterimage.

SUMMARY OF THE INVENTION

Accordingly, the present invention is directed to an LCD device and a method for driving the same that substantially obviate one or more problems due to limitations and disadvantages of the related art.

An object of the present invention is to provide an LCD device reducing ghost phenomenon by adjusting an on/off-time of lamps to deal with a liquid crystal response time difference of a pixel region caused by a temperature difference according to the position in the LCD and a method for driving the LCD device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for driving a liquid crystal display device. The liquid crystal display device includes a liquid crystal panel and a plurality of lamps. The method comprises: sequentially driving the plurality of lamps to supply light to the liquid crystal panel, at least one of the lamps having a different on-time interval from another one of the lamps.

In another aspect of the present invention, there is provided a method for driving a liquid crystal display device. The liquid crystal display device includes a liquid crystal panel and a plurality of lamps. The method comprises: sequentially driving the plurality of lamps to supply light to the liquid crystal panel, at least one of the lamps having a different off-time interval from another one of the lamps.

In a further another aspect of the present invention, there is provided a liquid crystal display device including: a liquid crystal panel; a plurality of lamps as a light source of the liquid crystal panel; and a lamp driving unit sequentially driving the plurality of lamps so that at least one of the lamps having a different on-time interval from another one of the lamps.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 5:
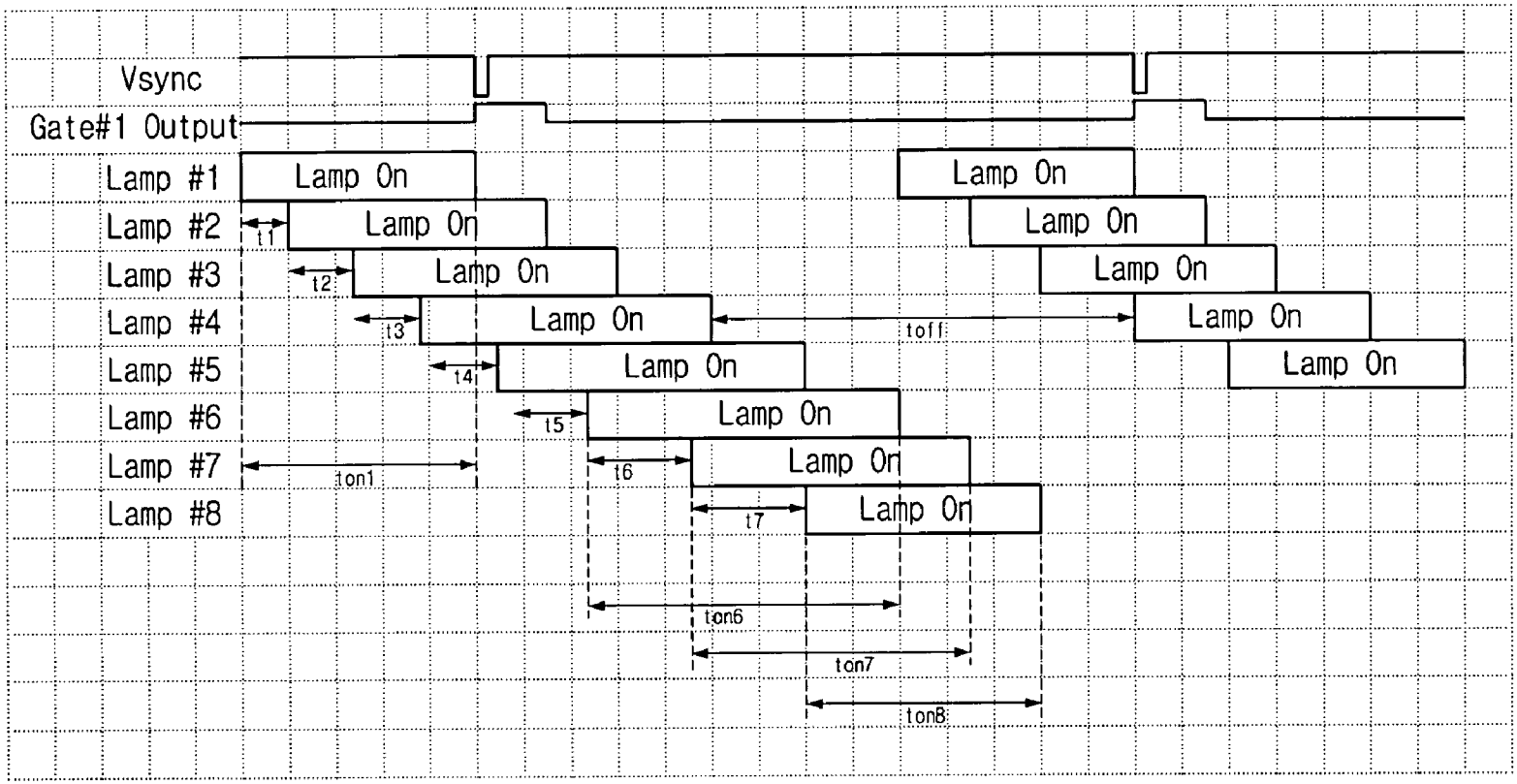
FIG. 5 illustrates a method for driving a backlight unit in an LCD device according to an embodiment of the present invention.

FIG. 5 illustrates a method for driving a backlight unit in a liquid crystal display (LCD) device according to an embodiment of the present invention.

As illustrated in FIG. 5, on/off-times of the first to eighth lamps are sequentially adjusted considering that a sequentially decreased temperature inside a backlight unit from a region of the first gate line group to a region of the last Nth gate line group in a direct-type LCD device. In the illustrated embodiment, the lamps are cold cathode fluorescent lamps (CCFL). However, the lamps may be other types of fluorescent lamps, light emitting diodes, or any other light sources.

That is, the response time of a liquid crystal in the LCD panel is faster in a high-temperature region and is slower in a low-temperature region. A lamp-on-time $t_{on}$ progressively decreases from the first lamp to the eighth lamp. Thus, a lamp-off-time $t_{off}$ becomes relatively longer. The $t_{on}$ and $t_{off}$ are an average response standard determining whether the LCD panel is in an on-state or an off-state. The $t_{on}$ and $t_{off}$ are determined according to whether the signals are inputted into a plurality of pixels or not.

The lamp on/off-time control is performed in a lamp driving unit. The lamp driving unit includes an inverter circuit generally. The inverter largely includes master and slave printed circuit boards (PCBs). The lamp on/off timing for removing the ghost phenomenon is set in an IC chip embedded in each of the PCBs. The lamp on/off timing set in the lamp driving unit takes into account the size of an LCD panel, the temperature of an LCD panel region, and the liquid characteristics according to a temperature.

When the lamp on/off timing is set in the lamp driving unit, the lamp driving unit receives a synchronize signal from the timing controller, and turns on/off lamps in synchronization with an LCD operation-time by using a gate driver and a data driver, thereby reducing the ghost phenomenon.

Accordingly, an interval starting from a point where the N-1$^{th}$ lamp is initially turned on to a point where the N$^{th}$ lamp is initially turned on is $t_{N-1}$. As shown in FIG. 5, there are intervals t1, t2, . . . t7. The length of each interval increases gradually from t1 to t7.

When each of the intervals t2, t3, t4, t5, t6, and t7 becomes sequentially longer, the on-time of the second to eighth lamps becomes relatively shorter to compensate the different temperature characteristics of the different regions in the LCD device. Accordingly, the lamps are controlled based on the different pixel operation-times in different regions of the LCD panel. Thus, although the lamp is driven by a scanning method, it provides an effect of an impulse driving method by varying an on-time interval of each lamp (different on/off-time intervals of each lamp).

Therefore, the ghost phenomenon reduces, which occurs according to the LCD device driving characteristics when displaying a moving picture, thereby improving the image quality.

The intervals t1 to t7 are respectively different, but only the intervals t5, t6, and t7 corresponding to the sixth to eighth lamp regions having an intensive temperature difference may be driven over a long duration (i.e., the on-times of the sixth to eighth lamps sequentially decrease) when an liquid crystal response time according to a temperature does not affect the occurrence of the ghost phenomenon.

Figure 6A:
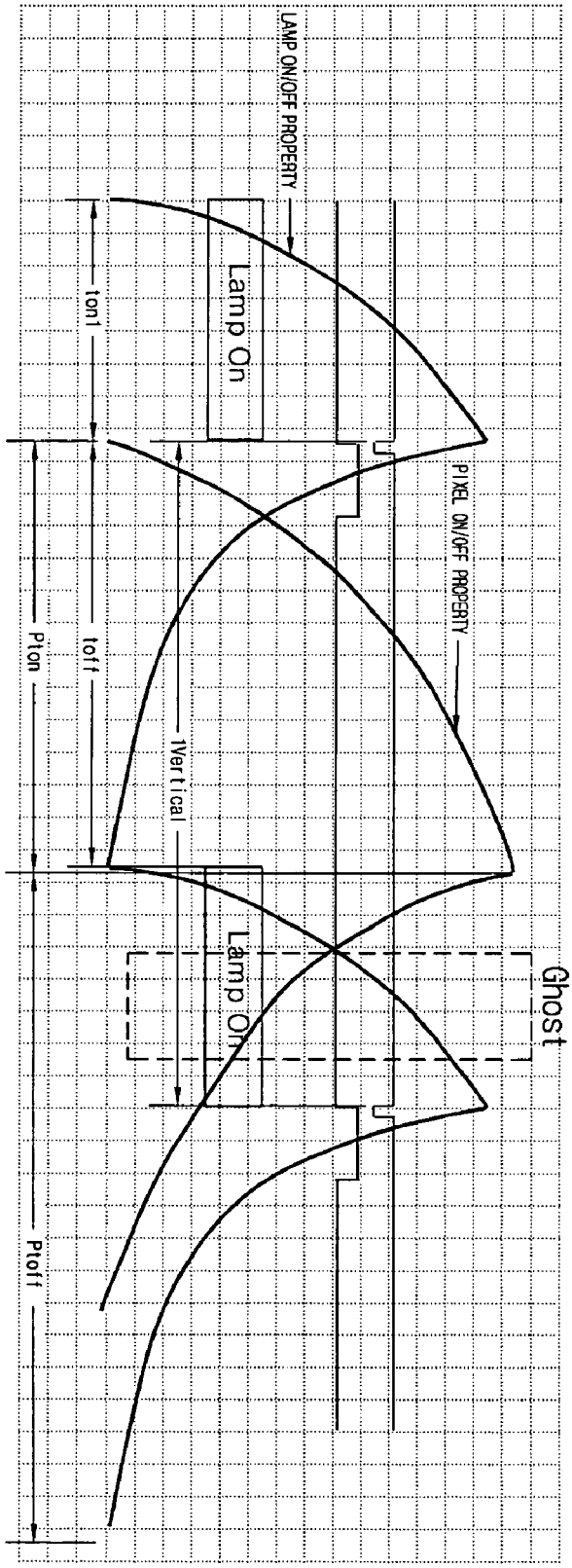
FIGS. 6A and 6B illustrates an improved ghost phenomenon in the first and eighth lamps of FIG. 5.
Figure 6B:
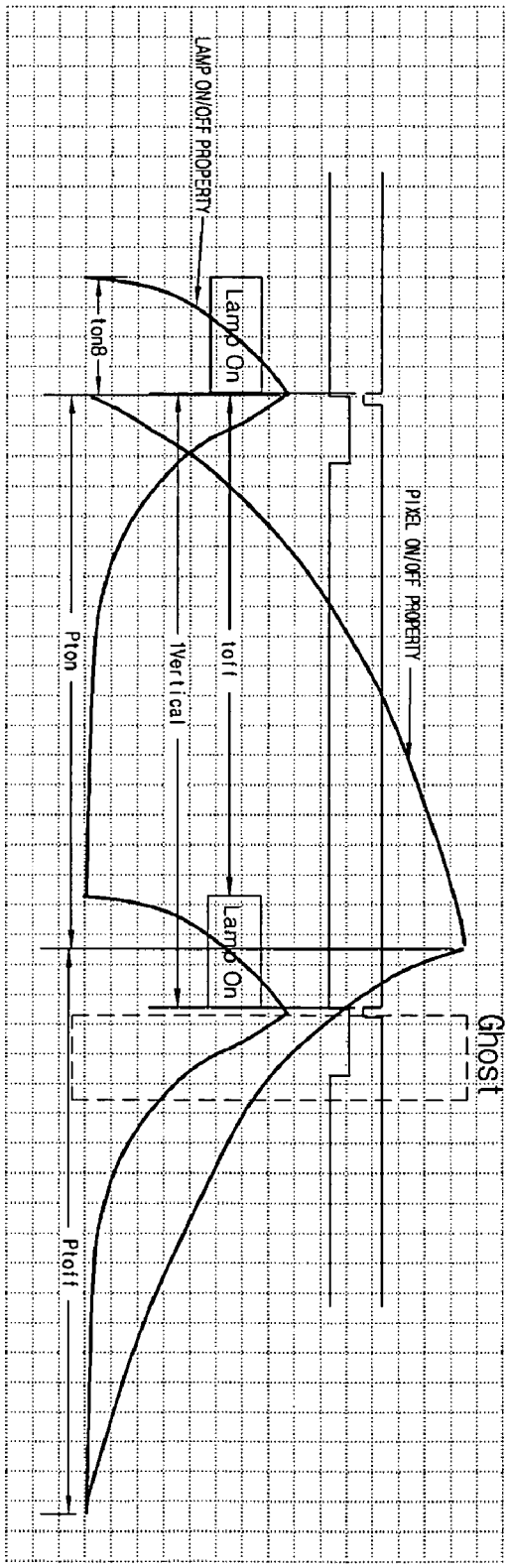

FIGS. 6A and 6B illustrate an improved ghost phenomenon in the first and eighth lamps of FIG. 5.

As illustrated in FIGS. 6A and 6B, since the first lamp region has a higher temperature than the eight lamp region, the first lamp region has a relatively faster liquid crystal response time.

When one image frame is displayed, a pixel region of the LCD panel is in an on-state until the first lamp is turned off. When the pixel region is in an off-state, the first lamp for the second image frame is in an on/off-state. A ghost phenomenon occurs in a moving picture because the response time of the pixel region is fast.

However, since a liquid crystal response time is fast in the first lamp region, an interval of an on-state in the first lamp (the first lamp for the next image frame) is short (approximately 3 ms). Therefore, a ghost phenomenon does not affect the moving picture in a display.

Referring to FIG. 6B, when an image frame is displayed, the eighth lamp is in an on-state. When the eighth lamp is in an off-state, a pixel region of an LCD panel is in an on-state. At this point, since the eighth lamp has a relatively lower temperature than the first lamp region, an on-time interval of a pixel region becomes longer (the response time of the crystal liquid becomes slower).

Accordingly, by shortening the on-time of the eighth lamp that is turned on before displaying an image frame, and lengthening the off-time relatively, the eighth lamp for the next image frame is turned on late to respectively deal with a delayed pixel response.

Additionally, the on-time of the lamp that is turned on late for the next image frame becomes in an on-state in a shorter time than a related art. Thus, when a pixel region becomes in an off-state, the eighth lamp is almost in an off-state, and thus the ghost phenomenon region reduces (below 3 ms). When the same lamp on-time is applied to all lamps like the related art, the ghost phenomenon region of the eighth lamp having a low temperature exists over 8 ms. Therefore, the moving picture quality is improved in the illustrated embodiment.

The present invention will be described in more detail with reference to a specific embodiment.

One vertical time of one image frame is set in 13.33 ms, and t1=1.5 ms, t2=1.6 ms, t3=1.65 ms, t4=1.7 ms, t5=1.8, t6=2 ms, t7=2.2 ms. The on-times of the eighth lamp, the seventh lamp, the sixth lamp, the fifth lamp, the fourth lamp, the third lamp, the second lamp, and the first lamp are 4.7 ms, 5 ms, 5.2 ms, 5.4 ms, 5.4 ms, 5.4 ms, 5.4 ms, and 5.4 ms, respectively.

At this point, with reference to the middle of the LCD panel, a pixel on-time Pton is 8 ms, and a pixel off-time Ptoff is 9 ms in the first lamp region direction. A pixel on-time Pton is 10 ms, and a pixel off-time Ptoff is 11 ms in the eighth lamp region direction.

Before displaying one image frame, the first lamp is turned on over 5.4 ms, and is turned off over 7.93 ms. The pixel on-time Pton is in an on-state during 8 ms. Next, when the first lamp for the next image frame is turned on after the first lamp off-time (7.93 ms) of the previous image frame, the pixel is in an off-state during 9 ms.

In the interval of the off-state of a pixel region, the ghost phenomenon occurs in an interval region of the on-state of the first lamp for the next image frame.

To deal with this, the eighth lamp is in an on-state ($t_{on}$: 4.7 ms) shorter than the first lamp, and is in an off-state ($t_{off}$: 8.6 ms) over a long duration. Due to the crystal liquid response delay of the LCD panel, a pixel region becomes in an on-state (10 ms) during an off interval of the eighth lamp.

Figure 1:
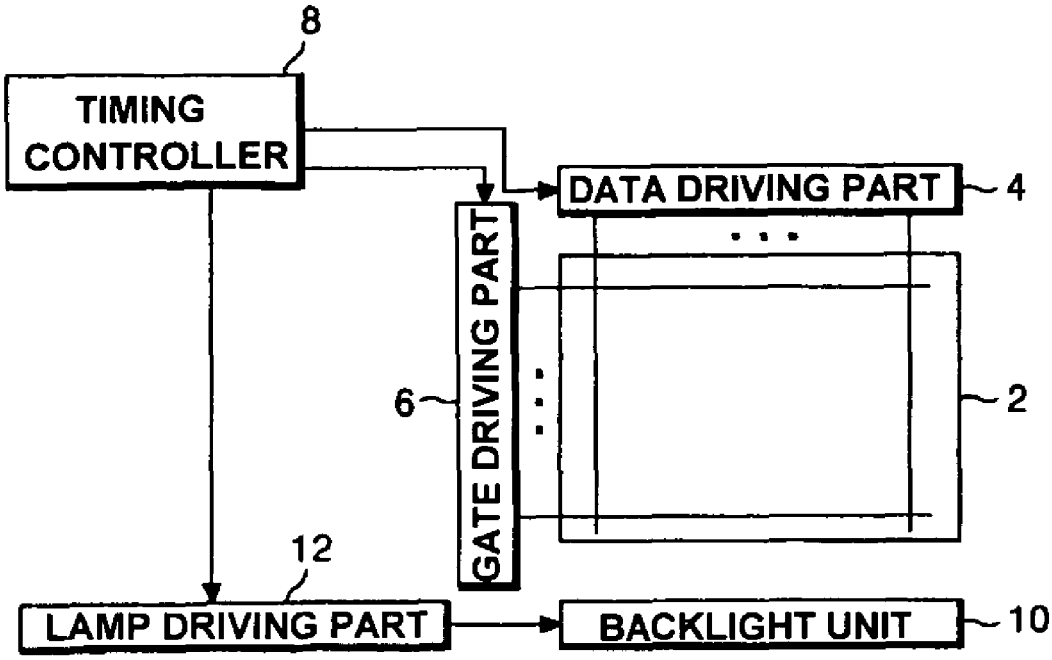
Fig.1 (Related Art)
FIG. 1 is a block diagram of a driving device in a related art LCD device.
Figure 2:
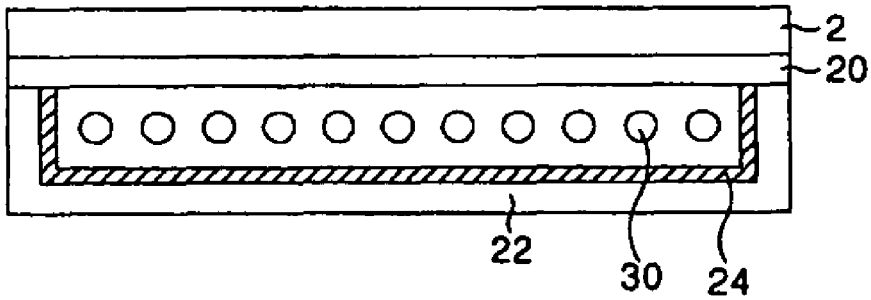
Fig.2 (Related Art)
FIG. 2 is a sectional view of a backlight unit and an LCD panel of FIG. 1.
Figure 3:
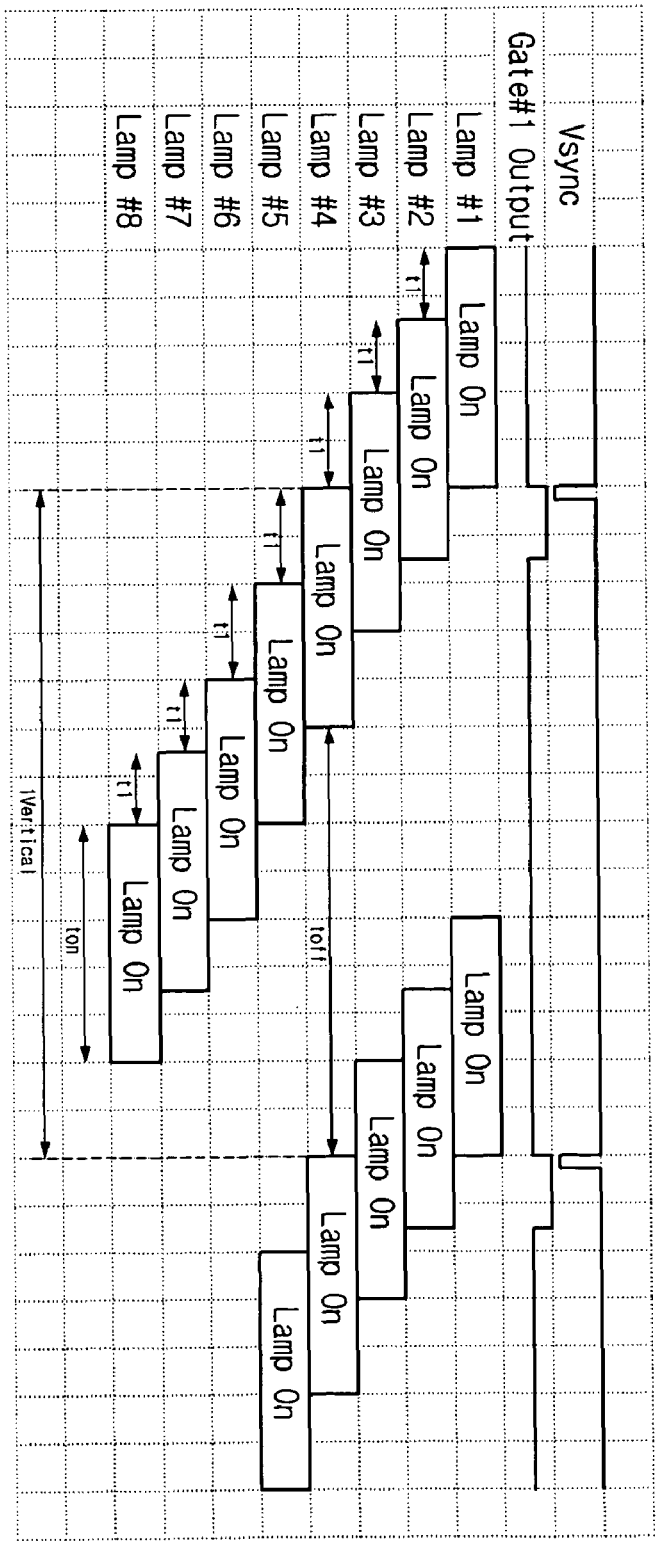
Fig.3 (Related Art)
FIG. 3 illustrates a method for driving scanning in a related art backlight unit.
Figure 4A:
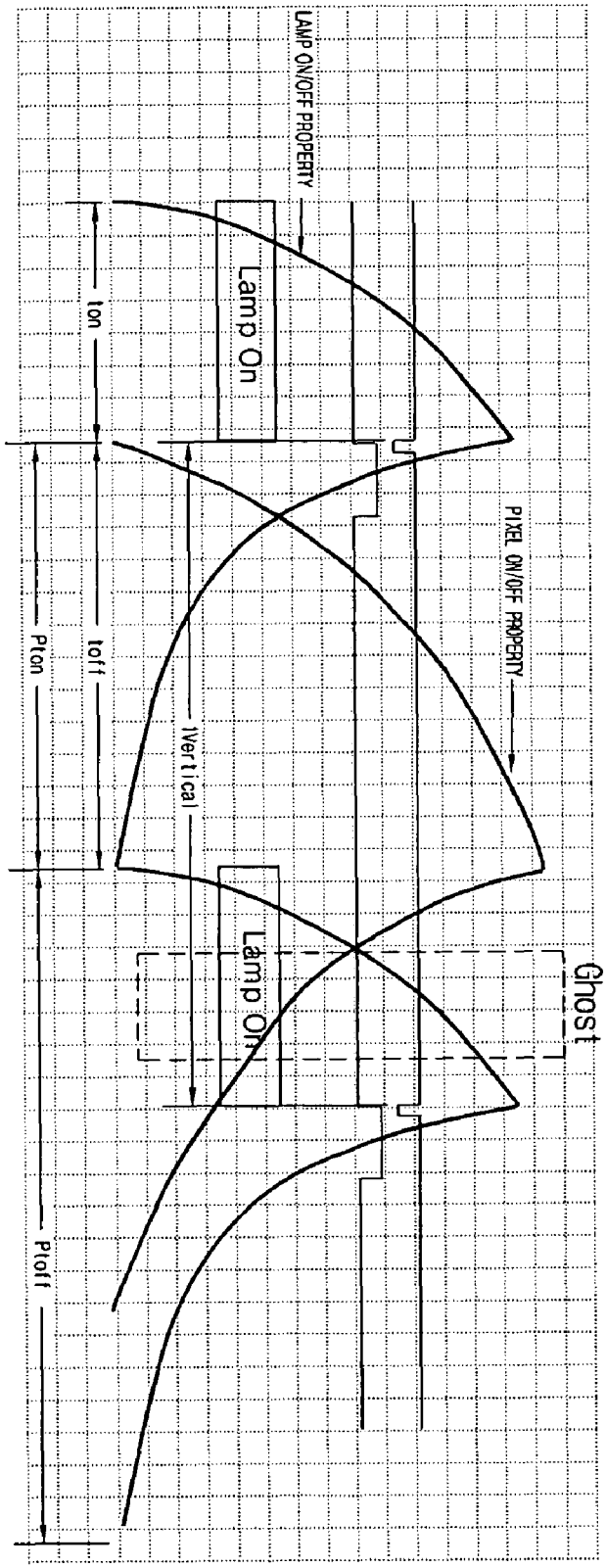
Fig.4A (Related Art)
FIGS. 4A and 4B illustrate a ghost phenomenon in the first and eighth lamps of FIG. 3.
Figure 4B:
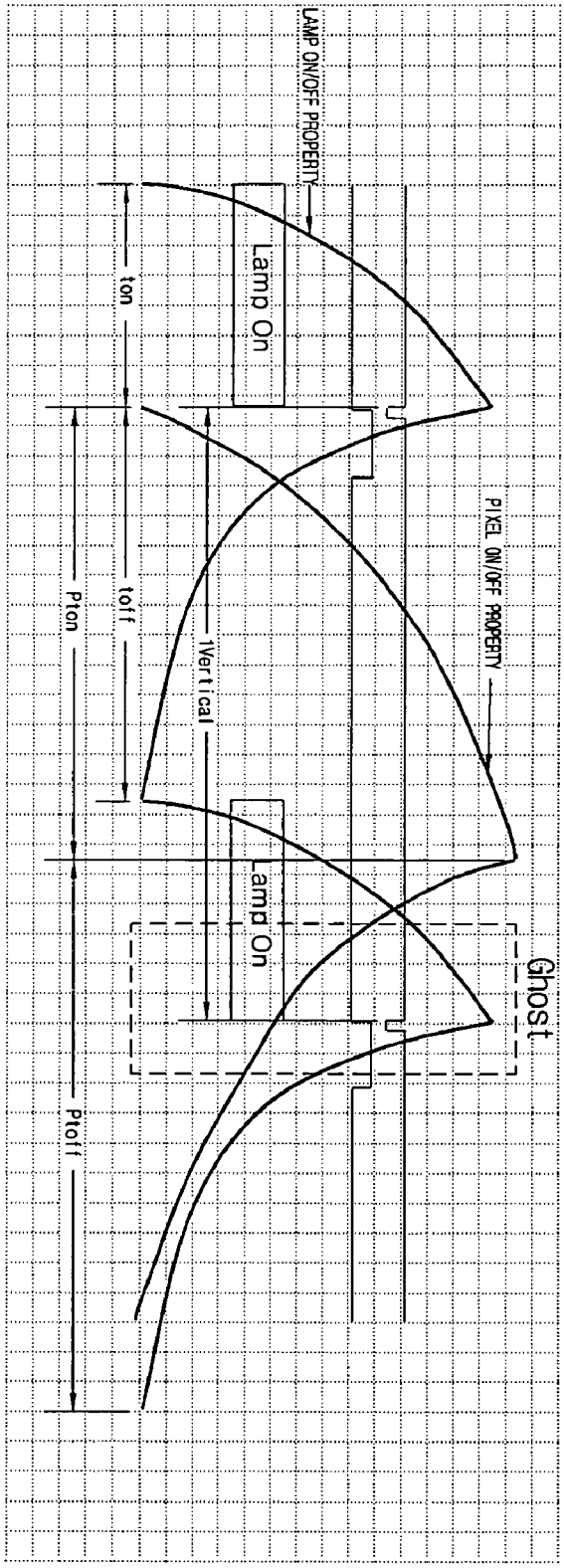
Fig.4B (Related Art)

When the eighth lamp for the next image frame is turned on during 4.7 ms, and then turned off, since the pixel region is in an off-state (11 ms), as illustrated in FIG. 4B, the ghost phenomenon occurs only in the region that is smaller than the region of when the lamp on-time is not adjusted.

As described above, the present invention shortens an on-time of the lamp and lengthens an off-time of the lamp in a response delay region of an LCD panel, and also lengthens an on-time of the lamp and shortens an off-time of the lamp in a region having a relatively faster response time.

Figure 7:
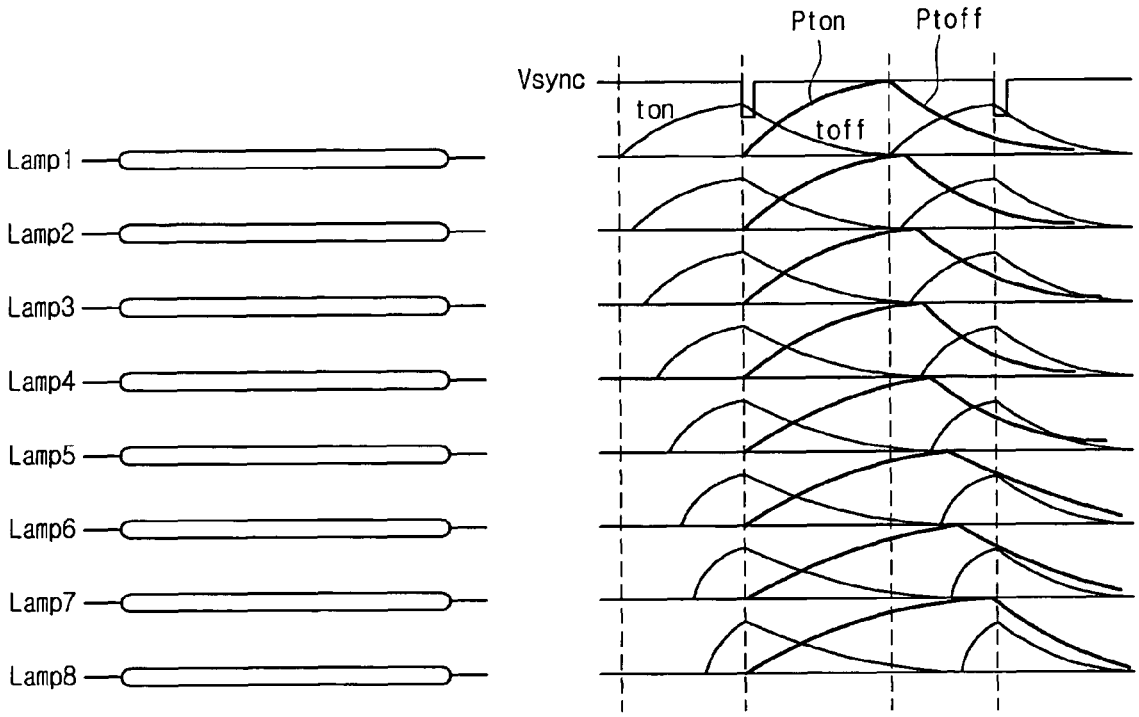
FIG. 7 is a view of sequentially-driven lamps in an LCD device according to an embodiment of the present invention.

FIG. 7 is a view of sequentially-driven lamps in an LCD device according to an embodiment of the present invention.

As illustrated in FIG. 7, the lamps are sequentially disposed in a backlight unit of an LCD device. When one image frame is displayed in response to a vertical synchronization signal, an on-time interval of the first lamp progressively decreases from the second lamp to the eighth lamp. An off-time interval of the lamp relatively increases.

To compensate the relatively slower response time of a liquid crystal when the temperature of an LCD panel progressively decreases from the first lamp to the eighth lamp, the illustrated embodiment of the present invention shortens an on-time $t_{on}$ of the lamp and lengthens an off-time $t_{off}$ of the lamp.

When a relatively larger temperature difference exist in the sixth to eighth lamp regions, and a temperature difference generated from the second to fifth lamps does not affect a response time, the first lamp to forth or fifth lamps have the same lamp on-time. The on-time of the lamp progressively decreases from the sixth lamp to the eighth lamp. A lamp off-time progressively increases from the sixth lamp to the eighth lamp.

According to the illustrated embodiment, an off-time interval of the seventh and eighth lamps for displaying the next image frame and an off interval of a pixel region are mostly overlapped to deal with a pixel response of an LCD panel, which is delayed in the seventh and eighth lamp regions. Therefore, the ghost phenomenon drastically reduces.

As described above, the illustrated embodiment controls the on/off-time of the lamps to deal with the liquid crystal response time of a pixel region due to the temperature difference at the position of the LCD panel. Therefore, when a moving picture is displayed, the ghost phenomenon drastically reduces.

Moreover, by turning off the lamp during an off interval after the pixel operation of the LCD panel, it prevents an afterimage from occurring in a back of a moving picture displayed using a pixel operation.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving a liquid crystal display device, the liquid crystal display device including a plurality of lamps and a liquid crystal panel including a liquid crystals, the method comprising:

sequentially driving the plurality of lamps to supply light to the liquid crystal panel, at least one of the lamps having a different on-time interval from another one of the lamps, wherein the on-time of the lamp in a first region having a relatively fast response time of the liquid crystal is lengthened and on-time of lamp in a second region having a relatively slow response time of the liquid crystal is shortened, wherein the second region in a low-temperature region is shortened in an on-time of the lamp and lengthened in an off-time of the lamp, and wherein the first region in a high-temperature region is lengthened in an on-time of the lamp and is shortened in an off-time of the lamp.

2. The method according to claim 1, wherein each of the lamps corresponds to one of a plurality of regions of the liquid crystal panel, and the on-time intervals of the lamps are respectively based on a liquid crystal response time of the regions corresponding to the lamps.

3. The method according to claim 2, wherein the liquid crystal response time of the liquid crystal panel is faster in one of the regions having a temperature higher than in another one of the regions having a relatively lower temperature.

4. The method according to claim 1, further comprising progressively increasing or decreasing the on-time intervals of the lamps from one of the lamps disposed on one side of the liquid crystal panel to another of the lamps disposed on another side of the liquid crystal panel.

5. The method according to claim 1, further comprising widening an overlapping period of an off-time interval of a pixel region and an off-time interval of a corresponding one of the lamps in the liquid crystal panel to remove a ghost phenomenon when a moving image is displayed in the liquid crystal panel.

6. The method according to claim 1, wherein the at least one of the lamps has a different off-time interval from the another one of the lamps.

7. The method according to claim 1, wherein each of the lamps has a different on-time interval from the other of the lamps.

8. The method according to claim 1, wherein a sum of the on-time of each of the lamps and an off-time of each of the lamps is substantially the same to all of the lamps.

9. A method for driving a liquid crystal display device, the liquid crystal display device including a plurality of lamps and a liquid crystal panel including a liquid crystal, the method comprising:

sequentially driving the plurality of lamps to supply light to the liquid crystal panel, at least one of the lamps having a different off-time interval from another one of the lamps, wherein on-time of the lamp in a first region having a relatively fast response time of the liquid crystal is lengthened and the on-time of the lamp in a second region having a relatively slow response time of the liquid crystal is shortened, wherein the second region in a low-temperature region is shortened in an on-time of the lamp and is lengthened in an off-time of the lamp in a response delay region of a LCD panel, and wherein the first region in a high-temperature region is lengthened in an on-time of the lamp and is shortened in an off-time of the lamp.

10. The method according to claim 9, wherein each of the lamps corresponds to one of a plurality of regions of the liquid crystal panel, and the off-time intervals of the lamps are based on by a liquid crystal response time of the regions corresponding to the lamps.

11. The method according to claim 10, wherein the liquid crystal response time of the liquid crystal panel is faster in one of the regions having a temperature higher than in another one of the regions having a relatively lower temperature.

12. The method according to claim 10, wherein off-time interval in one of the regions having a faster liquid crystal response time of the liquid crystal panel is shorter than that in another one of the regions having a relatively slower liquid crystal response time.

13. The method according to claim 9, further comprising progressively increasing or decreasing the off-time intervals of the lamps from one of the lamps disposed on one side of the liquid crystal panel to another one of the lamps disposed on another side of the liquid crystal panel.

14. The method according to claim 9, wherein each of the lamps has a different on-time interval from the other of the lamps.

15. The method according to claim 9, wherein a sum of an on-time of each of the lamps and the off-time of each of the lamps is substantially the same to all of the lamps.

16. A liquid crystal display device comprising: a liquid crystal panel; a plurality of lamps as a light source of the liquid crystal panel; and a lamp driving unit sequentially driving the plurality of lamps so that at least one of the lamps having a different on-time interval from another one of the lamps, wherein the on-time of the lamp in a first region having a relatively fast response time of the liquid crystal is lengthened and the on-time of the lamp in a second region having a relatively slow response time of the liquid crystal is shortened, wherein the second region in a low-temperature region is shortened in an on-time of the lamp and is lengthened in an off-time of the lamp in a response delay region of a LCD panel, and wherein the first region in a high-temperature region is lengthened in an on-time of the lamp and is shortened in an off-time of the lamp.

17. The liquid crystal display device according to claim 16, further comprising:

a gate line driver and a data line driver respectively supplying drive signals and data signals to the liquid crystal panel; and a timing controller controlling the gate line driver, the data line driver, and the lamp driving unit.

18. The liquid crystal display device according to claim 16, wherein each of the lamps corresponds to one of a plurality of regions of the liquid crystal panel, and the on-time intervals of the lamps are respectively based on a liquid crystal response time of the regions corresponding to the lamps.

19. The liquid crystal display device according to claim 18, wherein the liquid crystal response time of the liquid crystal panel is faster in one of the regions having a temperature higher than in another one of the regions having a relatively lower temperature.

20. The liquid crystal display device according to claim 16, wherein the lamp driving unit progressively increase or decrease the on-time intervals of the lamps from one of the lamps disposed on one side of the liquid crystal panel to another one of the lamps disposed on the other side of the liquid crystal panel.

21. The liquid crystal display device according to claim 16, wherein the lamp driving unit widens an overlapping period of an off-time interval of a pixel region and an off-time interval of a corresponding one of the lamps in the liquid crystal panel to remove a ghost phenomenon when a moving image is displayed in the liquid crystal panel when a moving image is displayed in the liquid crystal panel.

22. The liquid crystal display device according to claim 16, wherein the at least one of the lamps has a different off-time interval from the another one of the lamps.

23. The liquid crystal display device according to claim 16, wherein each of the lamps has a different on-time interval from the other of the lamps.

24. The liquid crystal display device according to claim 16, wherein a sum of the on-time of each of the lamps and an off-time of each of the lamps is substantially the same to all of the lamps.

* * * * *